US008731702B2

(12) United States Patent
Felkl et al.

(10) Patent No.: US 8,731,702 B2
(45) Date of Patent: May 20, 2014

(54) CONTINUOUS ROLLING TRAIN WITH INTEGRATION AND/OR REMOVAL OF ROLL STANDS DURING ONGOING OPERATION

(75) Inventors: Hans-Joachim Felkl, Forchheim (DE); Andreas Maierhofer, Marloffstein (DE)

(73) Assignee: Siemens Aktiengesellschaft, Munich (DE)

( * ) Notice: Subject to any disclaimer, the term of this patent is extended or adjusted under 35 U.S.C. 154(b) by 820 days.

(21) Appl. No.: 12/997,167

(22) PCT Filed: May 22, 2009

(86) PCT No.: PCT/EP2009/056225

§ 371 (c)(1),
(2), (4) Date: Dec. 9, 2010

(87) PCT Pub. No.: WO2009/153126

PCT Pub. Date: Dec. 23, 2009

(65) Prior Publication Data

US 2011/0098842 A1 Apr. 28, 2011

(30) Foreign Application Priority Data

Jun. 19, 2008 (EP) ..... 08011205

(51) Int. Cl.
*G06F 19/00* (2011.01)

(52) U.S. Cl.
USPC ..... 700/122; 700/175

(58) Field of Classification Search
USPC ..... 700/117, 122, 126, 127, 128, 129
See application file for complete search history.

(56) References Cited

U.S. PATENT DOCUMENTS 4,335,435 A * 6/1982 Miura ..... 700/149
5,619,880 A * 4/1997 Polster et al. ..... 72/11.4
5,720,196 A * 2/1998 Tamai et al. ..... 72/241.8

(Continued)

FOREIGN PATENT DOCUMENTS

JP 54031070 A 3/1979 ..... B21B 1/24
JP 62101309 A 5/1987 ..... B21B 31/18
JP 62289306 A 12/1987 ..... B21B 37/00
RU 2264873 C2 11/2005 ..... B21B 1/28
SU 986532 A1 1/1983 ..... B21B 37/18

OTHER PUBLICATIONS

International PCT Search Report, PCT/EP2009/056225, 12 pages, Mailed Aug. 27, 2009.

(Continued)

*Primary Examiner* — Mohammad Ali
*Assistant Examiner* — Nathan Laughlin
(74) *Attorney, Agent, or Firm* — King & Spalding L.L.P.

(57) ABSTRACT

In mill stands of a continuous rolling train, a product passes through the train is rolled such that the product upon leaving the train has predetermined final characteristics. To remove one of the stands, the mill stand to be removed is completely relieved of load according to a defined temporal load relieving sequence. Locally simultaneously with the load relieving, at least one other mill stand is placed under load according to a defined temporal loading sequence. The load-relieving and loading sequence are mutually adjusted to preserve the final product characteristics. A circumferential roll velocity is controlled until the stand has been completely relieved such that a discharge velocity corresponds always to a predetermined desired discharge velocity. After the complete load-relieving, a correspondence of the circumferential roll velocity to the desired discharge velocity is maintained and the working rolls are lifted off. The mill stand is then deactivated.

20 Claims, 8 Drawing Sheets

(56) References Cited

U.S. PATENT DOCUMENTS

| | | | | |
|---|---|---|---|---|
| 6,112,566 | A * | 9/2000 | Palzer et al. | 72/10.7 |
| 2004/0122547 | A1 * | 6/2004 | Seymour et al. | 700/117 |
| 2008/0060403 | A1 | 3/2008 | Felkl et al. | 72/12.3 |

OTHER PUBLICATIONS

Russian Grant Decision, Application No. 2011101732/02, 20 pages, Apr. 23, 2013.

* cited by examiner

CONTINUOUS ROLLING TRAIN WITH INTEGRATION AND/OR REMOVAL OF ROLL STANDS DURING ONGOING OPERATION

CROSS-REFERENCE TO RELATED APPLICATIONS

This application is a U.S. National Stage Application of International Application No. PCT/EP2009/056225 filed May 22, 2009, which designates the United States of America, and claims priority to EP Application No. 08011205.5 filed Jun. 19, 2008. The contents of which are hereby incorporated by reference in their entirety.

TECHNICAL FIELD

The present invention relates to an operating method for a continuous rolling train which has a number of roll stands, with a rolling stock passing through the continuous rolling train being rolled in a plurality of the roll stands in succession, such that the rolling stock has predetermined final properties when it leaves the rolling train.

The present invention also relates to a computer program which has machine code which can be executed directly by a control device of a continuous rolling train and the execution of which by the control device has the effect that the control device operates the continuous rolling train according to such an operating method.

The present invention also relates to a data carrier on which such a computer program is stored in machine-readable form.

The present invention also relates to a control device of a continuous rolling train, which control device is programmed with a computer program such that the control device operates the continuous rolling train according to an operating method of the type explained above.

Finally, the present invention relates to a continuous rolling train having a number of roll stands and having a control device of the above-described type, with the roll stands being controlled by the control device.

BACKGROUND

An operating method of the type mentioned at the beginning is known for example from US 2008/060403 A1. Said document explains a way in which the continuous operation of the continuous rolling train can be maintained despite the fact that the rolling stock passing through the continuous rolling train has a critical transition region which cannot be rolled safely. In essence, the teaching of US 2008/060403 A1 concerns tracking the path of the transition region through the continuous rolling train and lifting each of the roll stands of the continuous rolling train when the critical transition region reaches the respective roll stand and screwing down the respective roll stand on the rolling stock again and continuing the rolling process when the critical transition region has passed the respective roll stand. The rolling stock is thus rolled in the roll stands of the continuous rolling train only outside the critical transition region. The critical transition region itself and parts of the rolling stock adjoining the critical transition region pass through the entire continuous rolling train without being rolled.

In continuous rolling trains, rolling stock should be rolled with as little interruption as possible (that is, continuously). Therefore, at the entry side of the continuous rolling train, individual coils are brought together and connected to one another—generally by means of welding. This approach is taken in particular for the cold rolling of sheet metal, that is to say a strip-shaped rolling stock.

The rolling of the rolling stock causes the rolls of the roll stands to wear. Here, within one of the roll stands, the most intense wear occurs in the working rolls of the respective roll stand. Support rolls and—if present—intermediate rolls wear only to a lesser extent. In terms of the continuous rolling train as a whole, the wear increases toward the exit side of the continuous rolling train.

In the prior art, to exchange rolls of a roll stand, it is known to bring the continuous rolling train to a stop, wherein the rolling stock remains in the continuous rolling train, that is to say is merely brought to a halt. As a result of the stoppage, rolling defects are generated at the stoppage points of the rolling stock. The rolling defects may comprise in particular dimensional defects and surface defects. If relatively high demands are placed on the quality of the rolling stock, that part of the rolling stock in which the rolling defects occur must be scrapped. Here, that part of the rolling stock which is to be scrapped may have a considerable length, for example 50 to 100 m. Furthermore, operational efficiency is reduced on account of the temporary stoppage of the continuous rolling train.

SUMMARY

It would be possible both to eliminate the rolling defects and also increase operational efficiency if it were possible for a roll stand of the continuous rolling train to be removed from and integrated into the continuous rolling train in a jolt-free manner during ongoing operation of the continuous rolling train. Hence, according to various embodiments, such possibilities can be provided.

According to an embodiment, in an operating method for a continuous rolling train which has a number of roll stands, with a rolling stock passing through the continuous rolling train being rolled in a plurality of the roll stands in succession, such that the rolling stock has predetermined final properties when it leaves the rolling train, to remove one of the roll stands rolling the rolling stock from the continuous rolling train during the rolling of the rolling stock, the method comprises:

a control device of the continuous rolling train controls the roll stand to be removed such that the roll stand to be removed is completely relieved of load according to a defined temporal load relief profile, such that the roll stand to be removed rolls a certain section of the rolling stock during the load relief profile, the control device controls at least one other of the roll stands of the continuous rolling train such that the at least one other roll stand has load applied to it according to a defined temporal load application profile, wherein the load relief profile of the roll stand to be removed and the load application profile of the at least one other roll stand are coordinated with one another such that, during the load application profile, the at least one other roll stand rolls one and the same section of the rolling stock as the roll stand to be removed during the load relief profile, and such that the final properties of the rolling stock are maintained, —the control device controls a rotational speed of working rolls of the roll stand to be removed until the latter is completely relieved of load, in such a way that an exit speed of the rolling stock effected by the rolling of the rolling stock in the roll stand to be removed corresponds at all times to a predetermined setpoint exit speed, the control device controls the roll stand to be removed, after the latter has been completely relieved of load, and so as to maintain a correspondence of the rotational speed of the working rolls with the setpoint exit speed, such that the working rolls of the roll stand to be removed are lifted off the rolling stock, and said control device then brings the roll stand to be removed to a stop.

According to a further embodiment, to compensate the relief of load of the roll stand to be removed, the control device may apply load to a single other roll stand. According to a further embodiment, to compensate the relief of load of the roll stand to be removed, the control device may integrate the at least one other roll stand into the continuous rolling train. According to a further embodiment, to relieve the roll stand to be removed of load, the control device may control a rolling gap of the roll stand to be removed by correspondingly predefining a speed relationship relative to a roll stand, which is positioned upstream of the roll stand to be removed and is likewise rolling the rolling stock, of the continuous rolling train in conjunction with tension regulation, which acts on the screw-down of the roll stand to be removed, for a section of the rolling stock running into the roll stand to be removed. According to a further embodiment, to relieve the roll stand to be removed of load, the control device may control a rolling gap of the roll stand to be removed by position regulation or force regulation. According to a further embodiment, during the relief of load of the roll stand to be removed, the control device may regulate a tension prevailing in a section of the rolling stock running into the roll stand to be removed by adjusting the rotational speed of the working rolls of the roll stand to be removed, and—the control device may take the adjustment of the rotational speed of the working rolls of the roll stand to be removed into consideration in at least one roll stand, which is positioned downstream of the roll stand to be removed and is likewise rolling the rolling stock, of the continuous rolling train. According to a further embodiment, during the relief of load of the roll stand to be removed, the control device may regulate a tension prevailing in a section of the rolling stock running into the roll stand to be removed by adjusting the rotational speed of working rolls of a roll stand, which is positioned directly upstream of the roll stand to be removed and is likewise rolling the rolling stock, of the continuous rolling train and—the control device may take the adjustment of the rotational speed of the working rolls of the roll stand, which is positioned directly upstream of the roll stand to be removed and is likewise rolling the rolling stock, into consideration in at least one roll stand, which is positioned indirectly upstream of the roll stand to be removed and is likewise rolling the rolling stock, of the continuous rolling train.

According to another embodiment, in an operating method for a continuous rolling train which has a number of roll stands, with a rolling stock passing through the continuous rolling train being rolled in a plurality of the roll stands in succession, such that the rolling stock has predetermined final properties when it leaves the rolling train, in particular an operating method as described above, to integrate a roll stand which is not rolling the rolling stock into the continuous rolling train during the rolling of the rolling stock, the method may comprise:

a control device of the continuous rolling train controls the roll stand to be integrated such that a rotational speed of working rolls of the roll stand to be integrated corresponds to a setpoint exit speed of the rolling stock at the location of the roll stand to be integrated, and then controls the roll stand to be integrated such that the working rolls are screwed down on the rolling stock but the rolling stock is not yet rolled in the roll stand to be integrated, after the screw-down of the working rolls of the roll stand to be integrated on the rolling stock, the control device controls the roll stand to be integrated such that the roll stand to be integrated has load applied to it according to a defined temporal load application profile, such that the roll stand to be integrated rolls a certain section of the rolling stock during the load application profile, the control device controls at least one other of the roll stands of the continuous rolling train such that the at least one other roll stand is relieved of load according to a defined temporal load relief profile, wherein the load application profile of the roll stand to be integrated and the load relief profile of the at least one other roll stand are coordinated with one another such that, during the load relief profile, the at least one other roll stand rolls one and the same section of the rolling stock as the roll stand to be integrated during the load application profile, and such that the final properties of the rolling stock are maintained, after the application of load, the control device controls the rotational speed of the working rolls of the roll stand to be integrated such that an exit speed, effected by the rolling of the rolling stock in the roll stand to be integrated, of the rolling stock at the location of the roll stand to be integrated corresponds at all times to the setpoint exit speed.

According to a further embodiment of the above method, to compensate the application of load to the roll stand to be integrated, the control device may relieve a single other roll stand of load. According to a further embodiment of the above method, to compensate the application of load to the roll stand to be integrated, the control device may remove the at least one other roll stand from the continuous rolling train. According to a further embodiment of the above method, to apply load to the roll stand to be integrated, the control device may control a rolling gap of the roll stand to be integrated by correspondingly predefining a speed relationship relative to a roll stand, which is positioned upstream of the roll stand to be integrated and is rolling the rolling stock, of the continuous rolling train in conjunction with tension regulation, which acts on the screw-down of the roll stand to be integrated, for a section of the rolling stock running into the roll stand to be integrated. According to a further embodiment of the above method, to apply load to the roll stand to be integrated, the control device may control a rolling gap of the roll stand to be integrated by position regulation or force regulation. According to a further embodiment of the above method, during the application of load to the roll stand to be integrated, the control device may regulate a tension prevailing in a section of the rolling stock running into the roll stand to be integrated by adjusting the rotational speed of the working rolls of the roll stand to be integrated, and the control device may take the adjustment of the rotational speed of the working rolls of the roll stand to be integrated into consideration in at least one roll stand, which is positioned downstream of the roll stand to be integrated and is rolling the rolling stock, of the continuous rolling train. According to a further embodiment of the above method, during the application of load to the roll stand to be integrated, the control device may regulate a tension prevailing in a section of the rolling stock running into the roll stand to be integrated by adjusting a rotational speed of working rolls of a roll stand, which is positioned directly upstream of the roll stand to be integrated and is rolling the rolling stock, of the continuous rolling train, and the control device may take the adjustment of the rotational speed of the working rolls of the roll stand, which is positioned directly upstream of the roll stand to be integrated and is rolling the rolling stock, into consideration in at least one roll stand, which is positioned indirectly upstream of the roll stand to be integrated and is likewise rolling the rolling stock, of the continuous rolling train.

According to another embodiment, a computer program may have machine code which can be executed directly by a control device of a continuous rolling train and the execution of which by the control device has the effect that the control device operates the continuous rolling train according to an operating method as described above.

According to another embodiment, a data carrier may store a computer program as described above in machine-readable form.

According to another embodiment, a control device of a continuous rolling train, may be programmed with a computer program as described above such that the control device operates the continuous rolling train according to any of the operating methods as described above.

According to yet another embodiment, a continuous rolling train may have a number of roll stands and having a control device as described above, with the roll stands being controlled by the control device.

BRIEF DESCRIPTION OF THE DRAWINGS

Further advantages and details will emerge from the following description of exemplary embodiments in conjunction with the drawings, in which, in each case in the form of a diagrammatic illustration.

DETAILED DESCRIPTION

Figure 1:
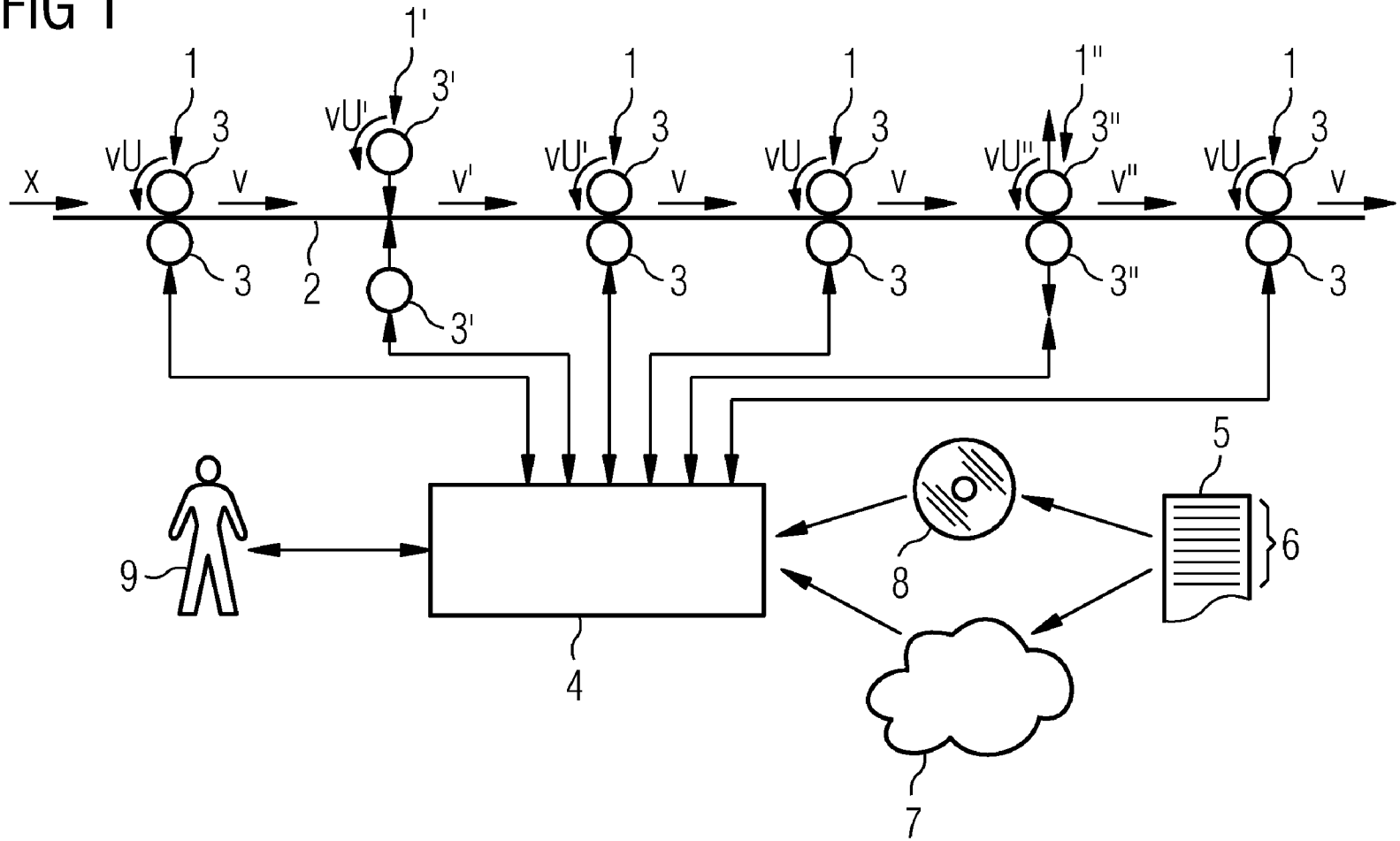
FIG. 1 schematically shows a continuous rolling train.

As regards the jolt-free removal of one of the roll stands, which is rolling the rolling stock, from the continuous rolling train, it is provided according to various embodiments that, during the rolling of the rolling stock, the following measures are taken:

a control device of the continuous rolling train controls the roll stand to be removed such that the roll stand to be removed is completely relieved of load according to a defined temporal load relief profile, such that the roll stand to be removed rolls a certain section of the rolling stock during the load relief profile, the control device controls at least one other of the roll stands of the continuous rolling train such that the at least one other roll stand has load applied to it according to a defined temporal load application profile, wherein the load relief profile of the roll stand to be removed and the load application profile of the at least one other roll stand are coordinated with one another such that, during the load application profile, the at least one other roll stand rolls one and the same section of the rolling stock as the roll stand to be removed during the load relief profile, and such that the final properties of the rolling stock are maintained, the control device controls a rotational speed of working rolls of the roll stand to be removed until the latter is completely relieved of load, in such a way that an exit speed of the rolling stock effected by the rolling of the rolling stock in the roll stand to be removed corresponds at all times to a predetermined setpoint exit speed, the control device controls the roll stand to be removed, after the latter has been completely relieved of load, and so as to maintain a correspondence of the rotational speed of the working rolls with the setpoint exit speed, such that the working rolls of the roll stand to be removed are lifted off the rolling stock, and said control device then brings the roll stand to be removed to a stop.

The fact that the roll stand to be removed rolls a certain section of the rolling stock during the load relief profile and the at least one other roll stand is controlled such that another roll stand rolls one and the same section of the rolling stock during the load application profile is also referred to hereinafter as "local simultaneity". Local simultaneity can be achieved directly by path tracking. Here, experts are generally familiar with path tracking.

Within the context of various embodiments, it is possible for the at least one other roll stand to be positioned upstream of the roll stand to be removed. It is however likewise possible for the at least one other roll stand to be positioned downstream of the roll stand to be removed.

In one embodiment, it is provided that, to compensate the relief of load of the roll stand to be removed, the control device applies load to a single other roll stand.

Here, this characteristic is meant not in the sense that no changes may occur in the other roll stands, but rather in the sense that the reduction in pass reduction arising as a result of the relief of load of the roll stand to be removed is compensated by a corresponding increase in pass reduction in a single other roll stand.

In one embodiment, it is provided that, to compensate the relief of load of the roll stand to be removed, the control device integrates the at least one other roll stand into the continuous rolling train. In this case, a roll stand exchange thus takes place.

To relieve the roll stand to be removed of load, it is possible for the control device to control a rolling gap of the roll stand to be removed by correspondingly predefining a speed relationship relative to a roll stand, which is positioned upstream of the roll stand to be removed and is likewise rolling the rolling stock, of the continuous rolling train in conjunction with tension regulation, which acts on the screw-down of the roll stand to be removed, for a section of the rolling stock running into the roll stand to be removed.

To relieve the roll stand to be removed of load, it is alternatively possible for the control device to control a rolling gap of the roll stand to be removed by position regulation or force regulation.

If the control device carries out position regulation or force regulation to relieve the roll stand to be removed of load, it is possible, during the relief of load of the roll stand to be removed, for the control device to regulate a tension prevailing in a section of the rolling stock running into the roll stand to be removed by adjusting the rotational speed of the working rolls of the roll stand to be removed. In this case, the control device preferably takes the adjustment of the rotational speed of the working rolls of the roll stand to be removed into consideration in at least one roll stand, which is positioned downstream of the roll stand to be removed and is likewise rolling the rolling stock, of the continuous rolling train.

It is alternatively possible, during the relief of load of the roll stand to be removed, for the control device to regulate a tension prevailing in a section of the rolling stock running into the roll stand to be removed by adjusting the rotational speed of working rolls of a roll stand, which is positioned directly upstream of the roll stand to be removed and is likewise rolling the rolling stock, of the continuous rolling train. In this case, the control device preferably takes the adjustment of the rotational speed of the working rolls of the roll stand, which is positioned directly upstream of the roll stand to be removed and is likewise rolling the rolling stock, into consideration in at least one roll stand, which is positioned indirectly upstream of the roll stand to be removed and is likewise rolling the rolling stock, of the continuous rolling train.

The jolt-free integration of a roll stand takes place substantially inversely to the jolt-free removal of a roll stand. As regards the jolt-free integration of a roll stand which is not rolling the rolling stock into the continuous rolling train during the rolling of the rolling stock, it is therefore provided according to various embodiments that, during the rolling of the rolling stock, the following measures are taken:

- a control device of the continuous rolling train controls the roll stand to be integrated such that a rotational speed of working rolls of the roll stand to be integrated corresponds to a setpoint exit speed of the rolling stock at the location of the roll stand to be integrated, and then controls the roll stand to be integrated such that the working rolls are screwed down on the rolling stock but the rolling stock is not yet rolled in the roll stand to be integrated,
- after the screw-down of the working rolls of the roll stand to be integrated on the rolling stock, the control device controls the roll stand to be integrated such that the roll stand to be integrated has load applied to it according to a defined temporal load application profile, such that the roll stand to be integrated rolls a certain section of the rolling stock during the load application profile,
- the control device controls at least one other of the roll stands of the continuous rolling train such that the at least one other roll stand is relieved of load according to a defined temporal load relief profile, wherein the load application profile of the roll stand to be integrated and the load relief profile of the at least one other roll stand are coordinated with one another such that, during the load relief profile, the at least one other roll stand rolls one and the same section of the rolling stock as the roll stand to be integrated during the load application profile, and such that the final properties of the rolling stock are maintained,
- after the application of load, the control device controls the rotational speed of the working rolls of the roll stand to be integrated such that an exit speed, effected by the rolling of the rolling stock in the roll stand to be integrated, of the rolling stock at the location of the roll stand to be integrated corresponds at all times to the setpoint exit speed.

The term "local simultaneity" is used here too. Here, the term "local simultaneity" is to be understood in the same sense as in the case of the removal of a roll stand from the continuous rolling train. Similarly to the removal of a roll stand, it is also possible during the integration of a roll stand that the at least one other roll stand is positioned upstream of the roll stand to be integrated. It is however likewise possible for the at least one other roll stand to be positioned downstream of the roll stand to be integrated.

In an embodiment, it is provided that, to compensate the application of load to the roll stand to be integrated, the control device relieves a single other roll stand of load. Similarly to the relief of load of a roll stand to be removed, the statement is to be understood here to mean that the pass reduction occurring as a result of the application of load to the roll stand to be integrated leads to a corresponding reduction in pass reduction of a single other roll stand which is relieved of load.

To compensate the application of load to the roll stand to be integrated, it is particularly preferable for the control device to remove the at least one other roll stand from the continuous rolling train.

Similarly to the removal of a roll stand, it is also possible during the integration of a roll stand that, to apply load to the roll stand to be integrated, the control device may control a rolling gap of the roll stand to be integrated by correspondingly predefining a speed relationship relative to a roll stand, which is positioned upstream of the roll stand to be integrated and is rolling the rolling stock, of the continuous rolling train in conjunction with tension regulation, which acts on the screw-down of the roll stand to be integrated, for a section of the rolling stock running into the roll stand to be integrated. It is likewise alternatively possible, to apply load to the roll stand to be integrated, for the control device to control a rolling gap of the roll stand to be integrated by position regulation or force regulation.

Similarly to the removal of a roll stand, in the case of position regulation or force regulation, it is possible, during the application of load to the roll stand to be integrated, for the control device to regulate a tension prevailing in a section of the rolling stock running into the roll stand to be integrated by adjusting the rotational speed of the working rolls of the roll stand to be integrated. In this case, the control device preferably takes the adjustment of the rotational speed of the working rolls of the roll stand to be integrated into consideration in at least one roll stand, which is positioned downstream of the roll stand to be integrated and is rolling the rolling stock, of the continuous rolling train.

It is alternatively possible, during the application of load to the roll stand to be integrated, for the control device to regulate a tension prevailing in a section of the rolling stock running into the roll stand to be integrated by adjusting a rotational speed of working rolls of a roll stand, which is positioned directly upstream of the roll stand to be integrated and is rolling the rolling stock, of the continuous rolling train. In this case, the control device preferably takes the adjustment of the rotational speed of the working rolls of the roll stand, which is positioned directly upstream of the roll stand to be integrated and is rolling the rolling stock, into consideration in at least one roll stand, which is positioned indirectly upstream of the roll stand to be integrated and is likewise rolling the rolling stock, of the continuous rolling train.

The computer program according to various embodiments has machine code, the execution of which by the control device has the effect that the control device operates the continuous rolling train according to an operating method as described above. A computer program of said type is stored in machine-readable form on the data carrier. The control device of the continuous rolling train is programmed with a computer program according to various embodiments. The continuous rolling train has a control device of said type.

According to FIG. 1, a continuous rolling train has a number of roll stands 1, 1', 1". Illustrated here are only working rolls 3, 3', 3" of the roll stands 1, 1', 1". The roll stands 1, 1', 1" may however have further rolls, for example support rolls and intermediate rolls. A rolling stock 2 passes through the continuous rolling train. The rolling stock 2 is generally of strip-shaped form, for example a metal sheet. In principle, the rolling stock 2 could however have a different cross-sectional shape.

As it passes through the continuous rolling train, the rolling stock 2 is rolled in a plurality of the roll stands 1, 1', 1" of the continuous rolling train in succession. Here, cold rolling of the rolling stock 2 generally takes place. Hot rolling of the rolling stock 2 is however also possible in principle. On account of the rolling of the rolling stock 2, the rolling stock 2 has predetermined final properties when it leaves the continuous rolling train, for example predetermined final dimensions and a predetermined surface texture (in particular surface roughness). Here, the final properties of the rolling stock 2 differ from the starting properties of the rolling stock 2. The starting properties of the rolling stock 2 are the properties the rolling stock 2 has upon entering the continuous rolling train.

It is possible for the rolling stock 2 to be rolled in all the roll stands 1, 1', 1" of the continuous rolling train. In FIG. 1, however, the roll stand 1' is not in engagement. The working rolls 3' of said roll stand 1' are thus spaced apart from the rolling stock 2. It will hereinafter be described inter alia how the roll stand 1' can be integrated into the continuous rolling train in a jolt-free manner during ongoing operation of the continuous rolling train (that is to say while the rolling stock 2 is being rolled in the continuous rolling train). It will likewise be described how the roll stand 1" which is in engagement in FIG. 1 can be removed from the continuous rolling train in a jolt-free manner during ongoing operation of the continuous rolling train.

In FIG. 1, the roll stand 1' to be integrated is the second of six roll stands 1, 1', 1" of the cold-rolling train. The roll stand 1" to be removed is the fifth of the roll stands 1, 1', 1" of the continuous rolling train. This illustration is however purely an example. It is possible for both the roll stand 1' to be integrated and also the roll stand 1" to be removed to be any one of the roll stands 1, 1', 1" of the continuous rolling train, that is to say the first, second, third etc. roll stand 1, 1', 1" of the continuous rolling train. Also, the roll stand 1' to be integrated may alternatively be arranged upstream or downstream of the roll stand 1" to be removed as viewed in the running direction x of the rolling stock 2. Finally, instead of six roll stands, the continuous rolling train may also have more or fewer roll stands 1, 1', 1".

The continuous rolling train has a control device 4 which controls the roll stands 1, 1', 1". The control device 4 thus defines how the continuous rolling train is operated. For this purpose, the control device 4 generally executes a computer program 5 with which the control device 4 is programmed.

According to FIG. 1, the computer program 5 has machine code 6 which can be directly executed by the control device 4. The execution of the machine code 6 by the control device 4 has the effect that the control device 4 operates the continuous rolling train according to operating processes which will be explained in more detail below in conjunction with further figures.

The computer program 5 may be supplied to the control device 4 in various ways. For example, it is possible for the computer program 5 to be supplied to the control device 4 via a computer-computer connection 7. The computer-computer connection 7 may for example be the World Wide Web or a local computer network (LAN). Alternatively, the computer program 5 may be supplied to the control device 4 by means of a data carrier 8 on which the computer program 5 is stored in machine-readable—usually digital—form. Purely by way of example, a CD-ROM is schematically illustrated as a data carrier 8 in FIG. 1. The data carrier 8 could however also be of some other form, for example a USB memory stick or SD memory card.

During operation, the control device 4 controls the continuous rolling train according to an operating method which will be explained below in conjunction with FIG. 2.

Figure 2:
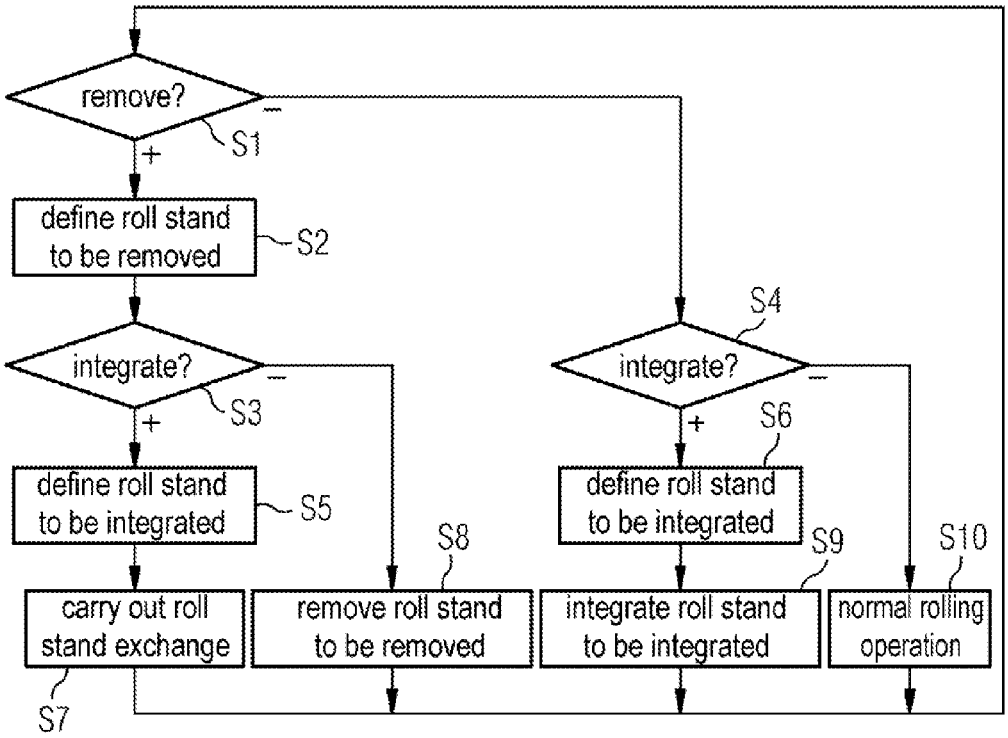
FIGS. 2 to 6 show flow diagrams.

According to FIG. 2, in a step S1, the control device 4 checks whether one of the roll stands 1, 1', 1" should be removed. For example, the control device 4 may for this purpose receive a corresponding input from an operator 9.

Similarly, in steps S3 and S4, the control device 4 checks whether one of the roll stands 1, 1', 1" should be integrated into the continuous rolling train. If this is the case, in steps S5 and S6, the control device 4 defines which of the roll stands 1, 1', 1" should be integrated. Here, too, a corresponding input from the operator 9 is possible.

Depending on the result of the checks in steps S1, S3 and S4, one of the steps S7 to S10 is then carried out. In step S7, a roll stand exchange takes place, that is to say the integration of the roll stand 1' to be integrated and the locally simultaneous (for definition, see above) removal of the roll stand 1" to be removed. The removal of the roll stand 1" to be removed takes place in step S8. The integration of the roll stand 1' to be integrated takes place in step S9. In step S10, normal rolling operation such as is generally known for continuous rolling trains takes place.

Figure 3:
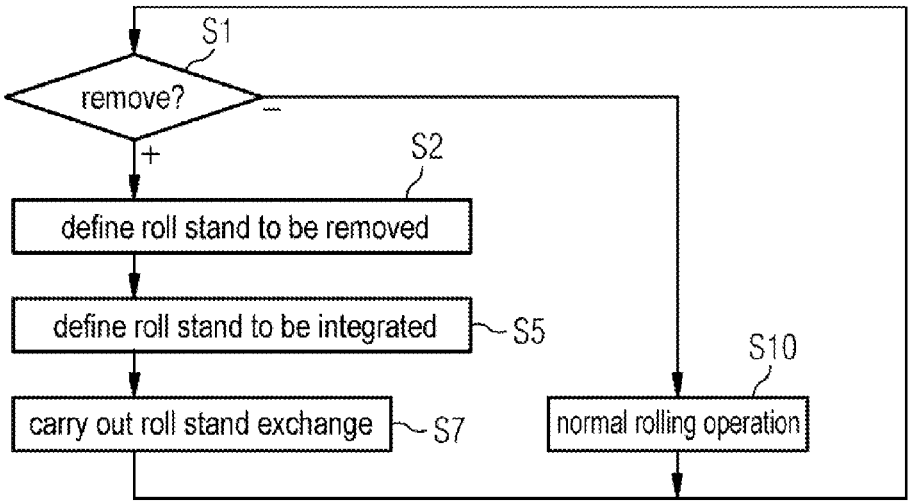

Instead of the method of FIG. 2, it is possible for a simplified method to be carried out, which will be explained below in conjunction with FIG. 3. The basic difference between the approaches of FIG. 2 and FIG. 3 is that, in the approach of FIG. 3, in contrast to the approach of FIG. 2, the isolated integration of a roll stand 1' to be integrated and the isolated removal of a roll stand 1" to be removed are not permitted, but rather a roll stand exchange always takes place. The approach of FIG. 3 therefore contains only the steps S1, S2, S5, S7 and S10 of FIG. 2.

Figure 4:
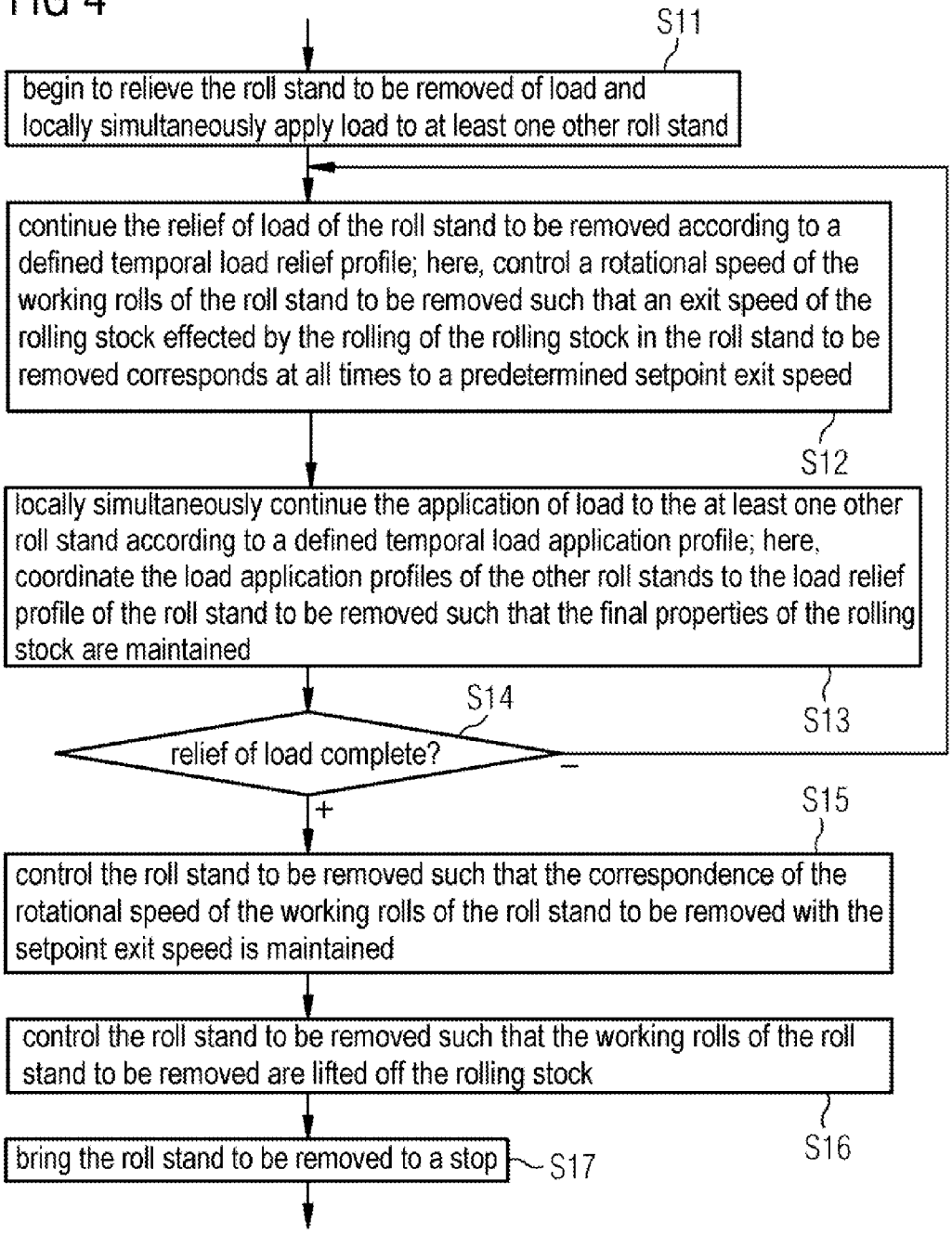

During the course of step S8, that is to say to remove the roll stand 1" to be removed without the simultaneous integration of another roll stand 1', the following steps are taken, according to FIG. 4:

In a step S11, the control device 4 begins to relieve the roll stand 1" to be removed of load. In step S11, the control device 4 begins to locally simultaneously apply load to at least one other roll stand 1, 1'. If, at the time of execution of step S11, the roll stand 1' is not loaded, it is (theoretically) possible here for the roll stand 1' which is initially not yet loaded to concomitantly have load applied to it. Generally, however, only the other roll stands 1 which are already in engagement and rolling the rolling stock 2 are loaded.

In a step S12, the control device 4 continues the relief of load of the roll stand 1" to be removed according to a defined temporal load relief profile. Here, the control device 4 controls a rotational speed vU" of the working rolls 3" of the roll stand 1" to be removed such that an exit speed v" of the rolling stock 2 effected by the rolling of the rolling stock 2 in the roll stand 1" to be removed corresponds at all times to a predetermined setpoint exit speed v"*. Here, the setpoint exit speed v"* may alternatively be temporally constant or temporally variable. During the determination of the required rotational speed vU", the control device 4 takes into consideration in particular the change in forward slip arising in the roll stand 1" to be removed as a result of the relief of load of the roll stand 1" to be removed. The corresponding approach is known per se, for example from US 2008/060403 A1 as cited above.

In a step S13, the control device 4 locally simultaneously continues the application of load to the at least one other roll stand 1, 1' according to a defined temporal load application profile. Here, too, the rotational speeds vU, vU' of the working rolls 3, 3' of the corresponding roll stands 1, 1' are always determined corresponding to the changing forward slip in the respective roll stand 1, 1', such that respective local exit speeds v, v' correspond to a respective setpoint exit speed v*, v'*.

The load application profiles of the other roll stands 1, 1' are coordinated with the load relief profile of the roll stand 1" to be removed such that the final properties of the rolling stock 2 are maintained. The relief of load of the roll stand to be removed and the application of load to the other roll stands 1, 1' therefore has no effect on the quality of the rolling stock 2 produced.

In a step S14, the control device 4 checks whether the relief of load of the roll stand 1" to be removed is already complete. If this is not the case, the control device 4 returns to step S12, and thus continues the relief of load of the roll stand 1" to be removed and the corresponding application of load to the at least one other roll stand 1, 1'.

When the relief of load of the roll stand 1" to be removed is complete, the control device 4 passes to a step S15. In step S15, the control device 4 controls the roll stand 1" to be removed such that the correspondence of the rotational speed vU" of the working rolls 3" of the roll stand 1" to be removed with the setpoint exit speed v"* is maintained. The control device 4 then controls the roll stand 1" to be removed such that the working rolls 3" of the roll stand 1" to be removed are lifted off the rolling stock 2. After the working rolls 3" of the roll stand 1" to be removed are lifted off, the control device 4 brings the roll stand 1" to be removed to a stop in a step S17.

At the end of the relief of load of the roll stand 1' to be removed, tensions ZA, ZB prevailing in the rolling stock 2 directly upstream and directly downstream of the roll stand 1" to be removed must be equal. This is because the rolling stock 2 would otherwise slip along the working rolls 3" of the roll stand 1" to be removed. The tensions ZA, ZB upstream and downstream of the roll stand 1" to be removed must therefore be matched to one another. The matching may alternatively take place at the start of step S11, between steps S11 and S12 or during the course of step S12. The corresponding approach is known in principle from US 2008/060403 A1, as already cited above.

In the approach of FIG. 4, the additional load application which occurs is generally distributed over a plurality of other roll stands 1. In individual cases, however, it is possible for the control device 4 to apply load to only a single other roll stand 1 during the execution of the method of FIG. 4.

Figure 5:
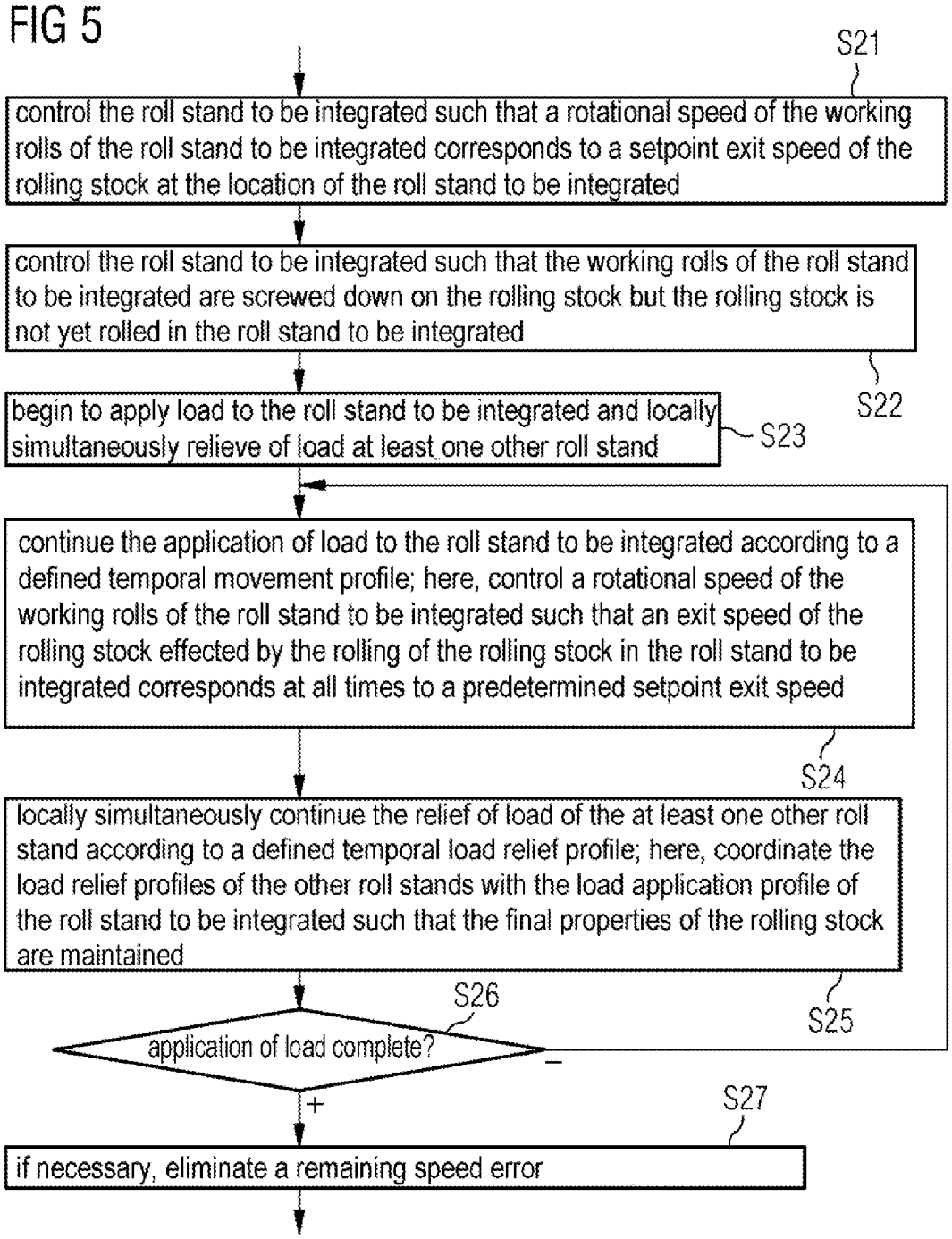

To integrate a roll stand 1' to be integrated without locally simultaneous removal of another roll stand 1", that is to say to implement the step S9 of FIG. 2, the following approach is taken, according to FIG. 5:

Firstly, in a step S21, the control device 4 controls the roll stand 1' to be integrated such that a rotational speed vU' of the working rolls 3' of the roll stand 1' to be integrated corresponds to a setpoint exit speed v'* of the rolling stock 2 at the location of the roll stand 1' to be integrated. In a step S22, the control device 4 then controls roll stand 1' to be integrated such that the working rolls 3' of the roll stand 1' to be integrated are screwed down on the rolling stock 2 but the rolling stock 2 is not yet rolled in the roll stand 1' to be integrated. The working rolls 3' of the roll stand 1' to be integrated thus merely revolve on the rolling stock 2 without rolling (that is to say deforming) the rolling stock 2.

In a step S23, the control device 4 begins to apply load to the roll stand 1' to be integrated according to a defined temporal load application profile. Locally simultaneously to the application of load to the roll stand to be integrated, the control device 4 begins to relieve at least one other roll stand 1, 1" of the continuous rolling train of load according to a defined temporal load relief profile. The load application profile of the roll stand 1' to be integrated and the load relief profile of the at least one other roll stand 1, 1" are coordinated with one another here such that the final properties of the rolling stock 2 are maintained.

In a step S24, the control device 4 continues the application of load to the roll stand 1' to be integrated according to the defined temporal load application profile. Here, the control device 4 controls the rotational speed vU' of the working rolls 3' of the roll stand 3' to be integrated such that an exit speed v' of the rolling stock 2 at the location of the roll stand 1' to be integrated corresponds to the setpoint exit speed v'*. Here, the setpoint exit speed v'* may alternatively be temporally constant or temporally variable.

In a step S25, the control device 4 continues the relief of load of the other roll stands 1, 1"—similarly to the application of load to the roll stand 1' to be integrated. It is also the case here that, during the determination of rotational speeds vU, vU" of the working rolls 3, 3" of the corresponding roll stands 1, 1", the control device 4 takes into consideration the amounts of forward slip, which change corresponding to the respective instantaneous relief of load, of the rolling stock 2.

In a step S26, the control device 4 checks whether the roll stand 1' to be integrated is already fully loaded. If this is not the case, the control device 4 returns to step S24, that is to say continues the load application process of the roll stand 1' to be integrated and the corresponding load relief process of the other roll stands 1, 1". Otherwise, the integration of the roll stand 1' to be integrated is—basically—complete. If necessary, however, any possibly remaining speed error may be eliminated in an additional step S27.

If no roll stand 1" is removed locally simultaneously to the integration of the roll stand 1' to be integrated, the relief of load to be effected is generally distributed across a plurality of other roll stands 1, 1". In individual cases, however, it is possible for only a single other roll stand 1, 1" to be relieved of load.

Figure 6:
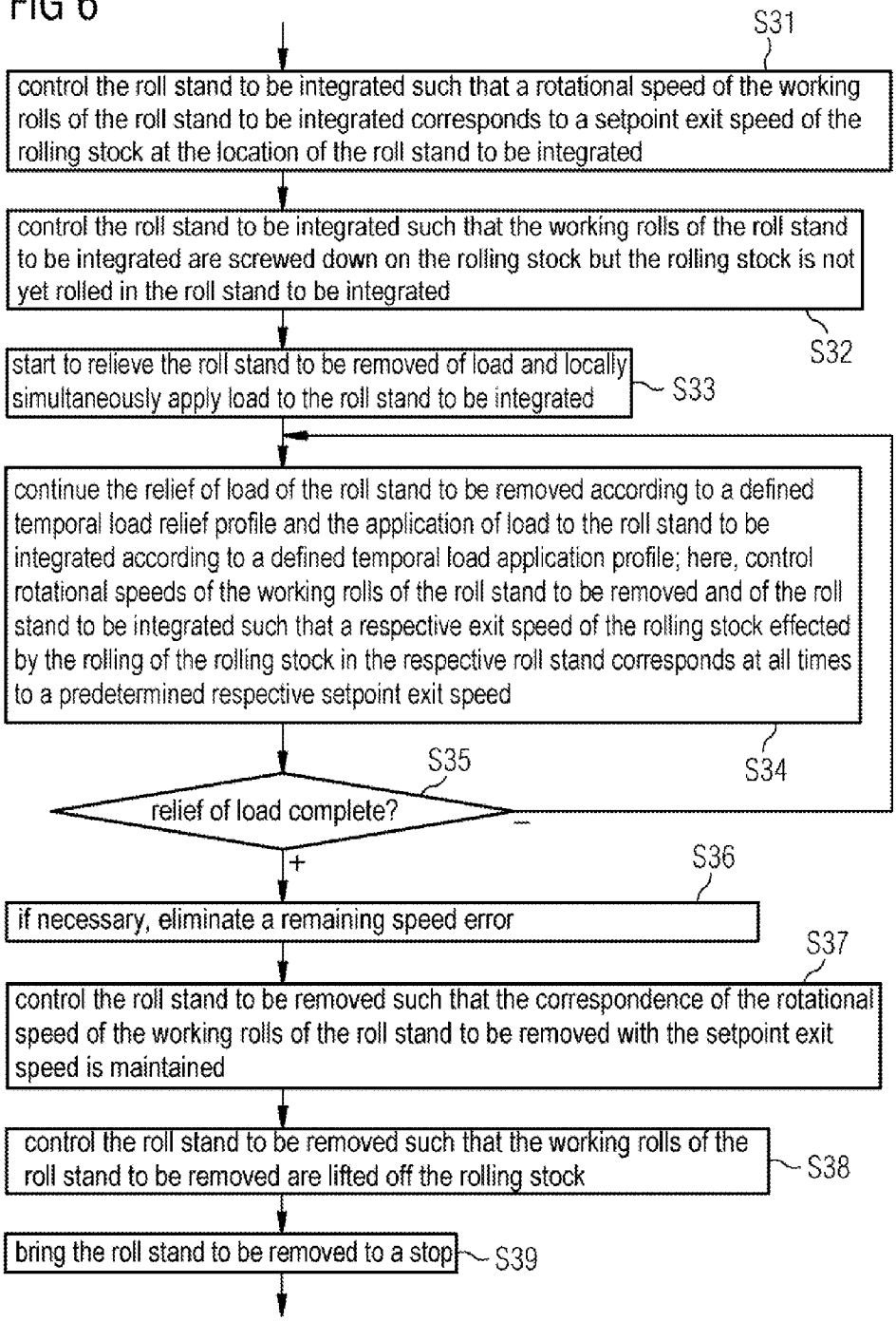

For a roll stand exchange, that is to say to implement the step S7 of FIG. 2 and FIG. 3, an approach is taken which is explained below in conjunction with FIG. 6. Here, FIG. 6 is essentially a combination of the approaches of FIG. 4 and FIG. 5. In detail:

Steps S31 and S32 correspond to steps S21 and S22 of FIG. 5. Steps S33 and S34 correspond to steps S11 to S13 of FIG. 4 or S23 to S25 of FIG. 5. A step S35 corresponds to the step S14 of FIG. 4. A step S36 corresponds to the step S27 of FIG. 5. Steps S37 to S39 correspond to steps S15 to S17 of FIG. 4.

The substantial difference between the approaches of FIGS. 4 and 5 on the one hand and FIG. 6 on the other hand thus consists in that, in the approach of FIG. 6, both the roll stand 1' to be integrated is integrated and also the roll stand 1" to be removed is removed, while in FIGS. 4 and 5 in each case only one of these measures is implemented.

In the approach of FIG. 6, there is generally a 1:1 correspondence between the integration of the roll stand 1' to be integrated and removal of the roll stand 1" to be removed. In individual cases, however, it is possible that, during the removal of the roll stand 1" to be removed, the roll stand 1' to be integrated is duly integrated, but load is nevertheless additionally applied to at least one of the roll stands 1. Likewise, it is conversely possible that, during the integration of the roll stand 1' to be integrated, one of the roll stands 1 is additionally relieved of load in addition to the removal of the roll stand 1" to be removed.

Figure 7:
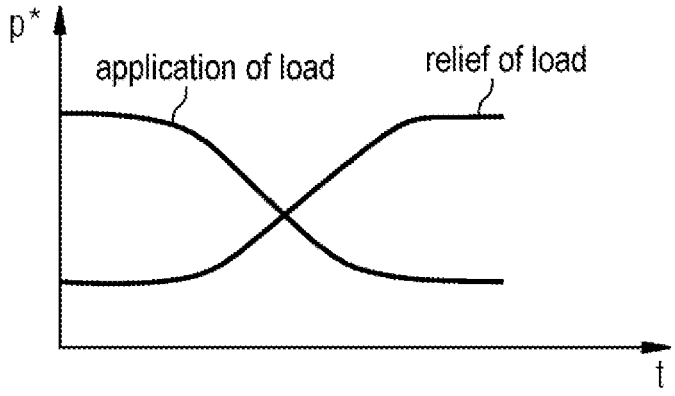
FIGS. 7 to 9 show possible load relief profiles and load application profiles.

It is possible, to relieve the roll stand 1" to be removed of load, for the control device 4 to control a rolling gap of the roll stand 1" to be removed by position control. In this case, the load relief profile of the roll stand 1" to be removed corresponds, as in FIG. 7, to a temporal profile of a rolling gap setpoint value p* for the roll stand 1" to be removed, which rolling gap setpoint value p* is increased from an initial value to a final value corresponding to the predetermined temporal profile as a function of the time t. At the initial value, the working rolls 3" of the roll stand 1" to be removed roll the rolling stock 2. At the final value, the working rolls 3" of the roll stand 1" to be removed just no longer roll the rolling stock 2, but merely revolve on the rolling stock 2.

Similarly, to apply load to the roll stand 1' to be integrated, it is possible for the control device 4 to control a rolling gap of the roll stand 1' to be integrated by position control. In this case, the load application profile of the roll stand 1' to be integrated runs substantially inversely to the load relief profile of the roll stand 1" to be removed.

The initial value and final value of the rolling gap setpoint value p* may be specific to the stand. In particular, the value at which the working rolls 3', 3" merely revolve is dependent on the thickness of the rolling stock 2 at the location of the respective roll stand 1', 1". The value at which the rolling stock 2 is actively rolled, and therefore at which deformation of the rolling stock 2 takes place, may be dependent on the pass sequence.

Figure 8:
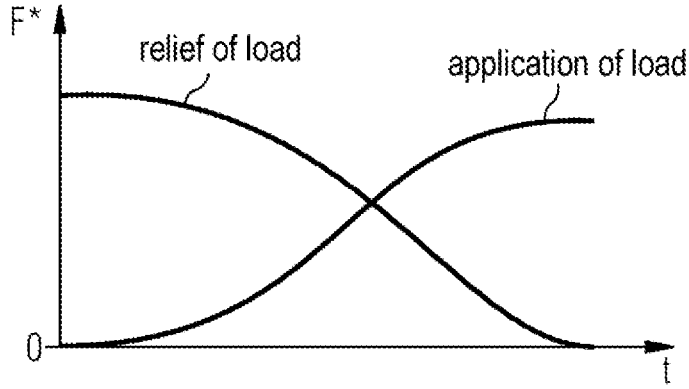

As an alternative to position control, to relieve the roll stand 1" to be removed of load, it is possible for the control device 4 to control the rolling gap of the roll stand 1" to be removed by force control. In this case, a setpoint rolling force F* with which the roll stand 1" to be removed rolls the rolling stock 2 is reduced, as in FIG. 8, according to a defined temporal profile from a relatively high initial value to a relatively low final value (zero or close to zero). At the high value, active rolling (deformation) of the rolling stock 2 takes place. At the low value, no plastic deformation of the rolling stock 2 takes place.

Similarly, to apply load to the roll stand 1' to be integrated, the control device 4 may control the rolling gap of the roll stand 1' to be integrated by force control. The temporal load application profile is, according to FIG. 8, substantially the inverse of the load relief profile of the roll stand 1" to be removed.

Figure 9:
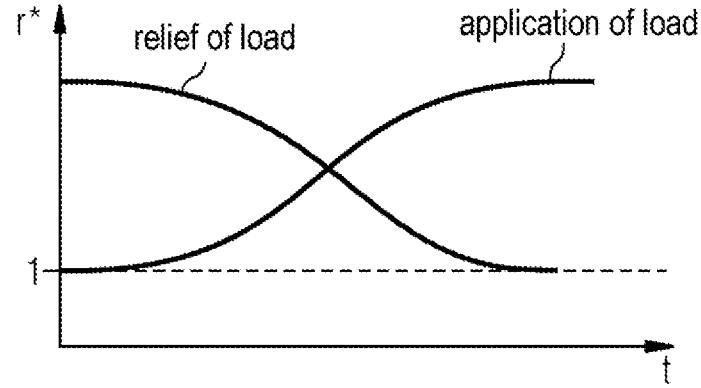
Figure 10:
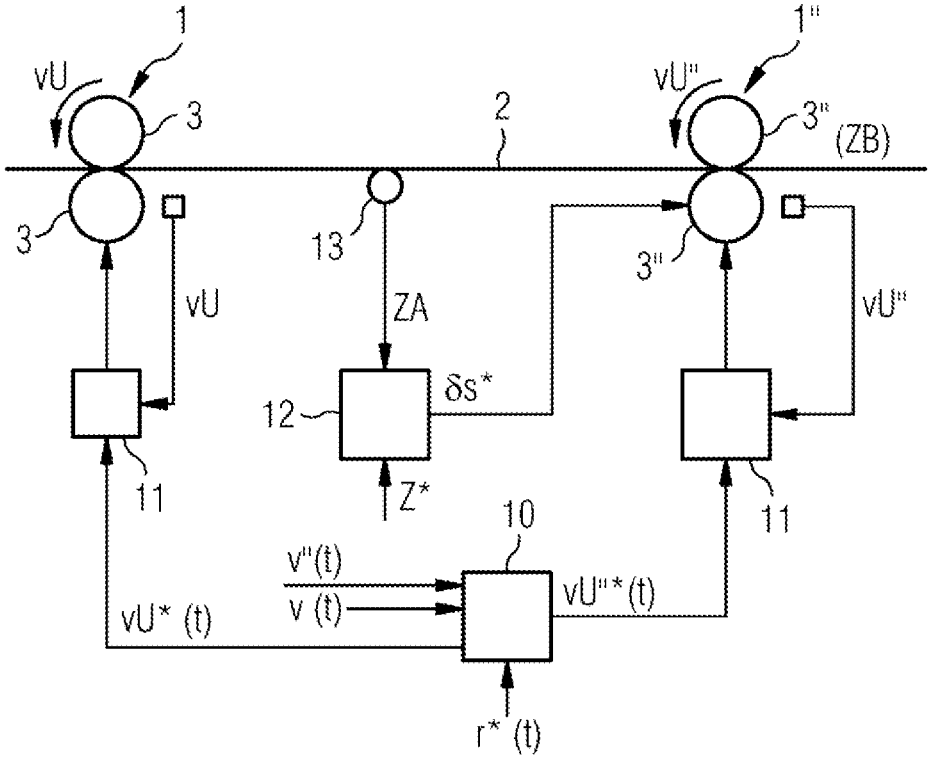
FIGS. 10 to 12 show possible embodiments of a section of the continuous rolling train from FIG. 1.

As a further alternative according to FIGS. 9 and 10, to relieve the roll stand 1" to be removed of load, it is possible for the control device 4 to control the rolling gap of the roll stand 1" to be removed by correspondingly predefining a speed relationship r* relative to a roll stand 1. Here, the roll stand 1 in question is positioned upstream of the roll stand 1" to be removed and is likewise rolling the rolling stock 2. Said roll stand is therefore not a roll stand 1' to be integrated. In this case, corresponding to FIG. 10, the control device 4 realizes a control block 10 to which are supplied firstly the speed relationship r* as a function of the time t and secondly the (measured or modeled) exit speeds v, v" of the upstream roll stand 1 and of the roll stand 1" to be removed. In the control block 10, on the basis of the speed relationship r* and the exit speeds v, v", the setpoint rotational speed vU* for the working rolls 3 of the upstream roll stand 1 and/or the setpoint rotational speed vU"* for the working rolls 3" of the roll stand 1" to be removed are determined such that the ratio of the exit speeds v, v" is equal to the speed relationship r*. The setpoint rotational speeds vU, vU"* are correspondingly set—directly or for example by means of speed regulators 11. Alternatively to the exit speeds v, v", the corresponding setpoint exit speeds v*, v"* may also be taken into consideration.

In the approach of FIG. 10, it is additionally necessary for the tension ZA upstream of the roll stand 1" to be removed to be adjusted to a predetermined setpoint tension Z*. This takes place in that the control device 4 realizes a tension regulator 12 which, by means of a corresponding corrective signal δs*, acts on the screw-down of the roll stand 1" to be removed. Here, the tension ZA is measured by means of a suitable measuring element 13.

To relieve the roll stand 1" to be removed of load, the speed relationship r* is, according to FIG. 9, reduced gradually from a value greater than one to the value of one according to a predetermined temporal profile. In conjunction with the tension regulation, which acts on the screw-down of the roll stand 1" to be removed, the degree of deformation is in this case set automatically. The corresponding approach is familiar to experts in the field of the cold-rolling of strips.

The integration of the roll stand 1' to be integrated may take place in a similar way. Only the temporal profile of the speed relationship r* must be correspondingly inverted, as in FIG. 9.

The roll stand 1' to be integrated and the roll stand 1" to be removed are generally integrated and removed in one and the same way, that is to say are both regulated either by position control or by force control or using the speed relationship r*. It is however theoretically also possible for the roll stand 1' to be integrated and the roll stand 1" to be removed to be regulated in different ways to one another. In this case, however, the coordination is more complex in terms of the details.

Figure 11:
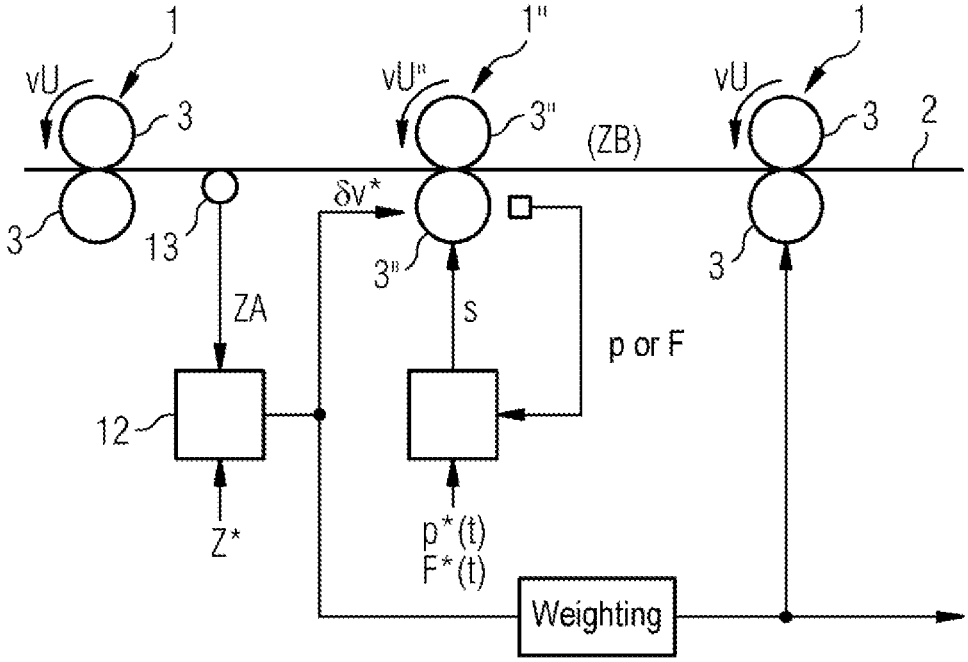
Figure 12:
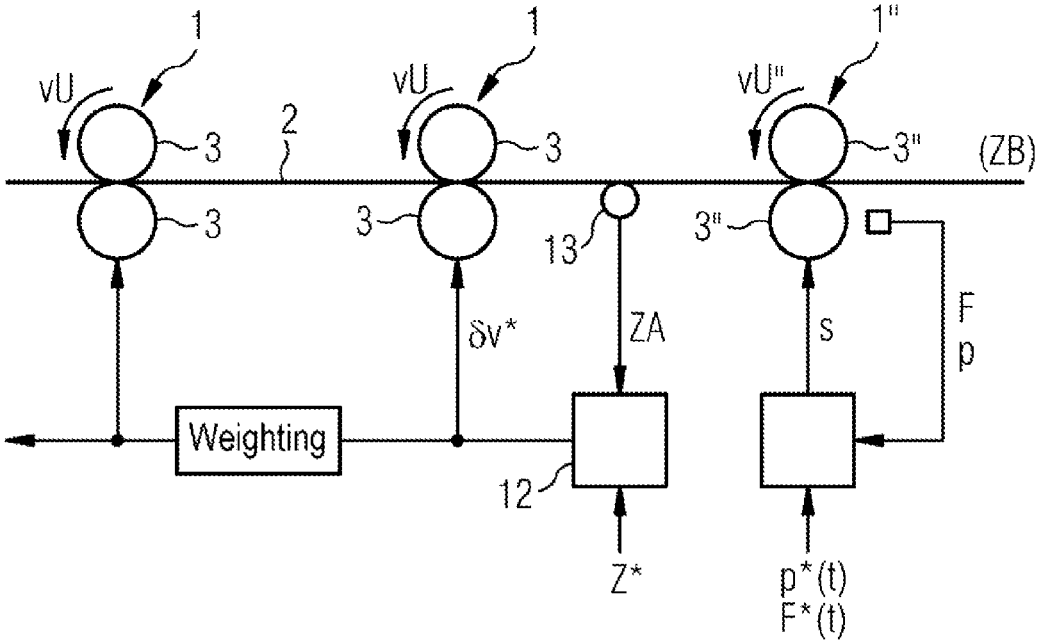

Even if the relief of load of the roll stand 1" to be removed or the integration of the roll stand 1' to be integrated takes place by position or force control, the tension ZA in the section of the rolling stock 2 directly upstream of the respective roll stand 1', 1" must be regulated. This preferably takes place by virtue of a corrective value δv* being superposed on a rolling speed. The corrective value δv* may, according to FIG. 11, be superposed by virtue of the control device 4 regulating the rotational speed vU', vU" of the roll stand 1' to be integrated or of the roll stand 1" to be removed. In this case, the control device 4 takes the adjustment of the rotational speed vU', vU" of the working rolls 3', 3" of the roll stand 1' to be integrated and of the roll stand 1" to be removed into consideration in at least one roll stand 1 which is likewise rolling the rolling stock 2 but is positioned downstream of the roll stand 1', 1" to be integrated or removed.

It is alternatively possible for the control device 4, using the corrective value δv*, to regulate the tension ZA in the section of the rolling stock 2 running into the corresponding roll stand 1', 1" by adjusting the rotational speed vU of the working rolls 3 of the roll stand 1, which is positioned directly upstream of the respective roll stand 1', 1" and is likewise rolling the rolling stock 2, and thereby correcting the rotational speed vU of said roll stand 1. In this case, the control device 4 takes the adjustment of the rotational speed vU of the working rolls 3 of the roll stand 1 directly upstream into consideration in at least one further roll stand 1 in which the rolling stock 2 is likewise being rolled, with the latter roll stand 1 however being positioned only indirectly upstream of the roll stand 1', 1" to be integrated or removed.

The present invention has numerous advantages. In particular, an integration and removal of roll stands 1, 1', 1" is possible during ongoing operation of the continuous rolling train. The desired high availability of the continuous rolling train is therefore maintained despite the integration and removal. Rolling stock defects nevertheless do not arise during the integration and removal. The desired final dimensions and surface properties are maintained. No scrap is produced.

The above description serves merely to explain the present invention. The scope of protection of the present invention should however be defined exclusively by the appended claims.

What is claimed is:

1. An operating method for a continuous rolling train which has a number of roll stands, with a rolling stock passing through the continuous rolling train being rolled in a plurality of the roll stands in succession, such that the rolling stock has predetermined final properties when it leaves the rolling train, wherein to remove one of the roll stands rolling the rolling stock from the continuous rolling train during the rolling of the rolling stock, the method comprises:

controlling by a control device of the continuous rolling train the roll stand to be removed such that the roll stand to be removed is completely relieved of load according to a defined temporal load relief profile, such that the roll stand to be removed rolls a certain section of the rolling stock during the load relief profile, controlling by the control device at least one other of the roll stands of the continuous rolling train such that the at least one other roll stand has load applied to it according to a defined temporal load application profile, wherein the load relief profile of the roll stand to be removed and the load application profile of the at least one other roll stand are coordinated with one another such that, during the load application profile, the at least one other roll stand rolls one and the same section of the rolling stock as the roll stand to be removed during the load relief profile, and such that the final properties of the rolling stock are maintained, controlling by the control device a rotational speed of working rolls of the roll stand to be removed until the roll stand to be removed is completely relieved of load, in such a way that an exit speed of the rolling stock effected by the rolling of the rolling stock in the roll stand to be removed corresponds at all times to a predetermined setpoint exit speed, and controlling by the control device the roll stand to be removed, after the roll stand to be removed has been completely relieved of load, and so as to maintain a correspondence of the rotational speed of the working rolls with the setpoint exit speed, such that the working rolls of the roll stand to be removed are lifted off the rolling stock, and said control device then brings the roll stand to be removed to a stop.

2. The operating method according to claim 1, wherein, to compensate the relief of load of the roll stand to be removed, the control device applies load to a single other roll stand.

3. The operating method according to claim 1, wherein, to compensate the relief of load of the roll stand to be removed, the control device integrates the at least one other roll stand into the continuous rolling train.

4. The operating method according to claim 1, wherein, to relieve the roll stand to be removed of load, the control device controls a rolling gap of the roll stand to be removed by correspondingly predefining a speed relationship relative to a roll stand, which is positioned upstream of the roll stand to be removed and is likewise rolling the rolling stock, of the continuous rolling train in conjunction with tension regulation, which acts on the screw-down of the roll stand to be removed, for a section of the rolling stock running into the roll stand to be removed.

5. The operating method according to claim 1, wherein, to relieve the roll stand to be removed of load, the control device controls a rolling gap of the roll stand to be removed by position regulation or force regulation.

6. The operating method according to claim 5, wherein during the relief of load of the roll stand to be removed, the control device regulates a tension prevailing in a section of the rolling stock running into the roll stand to be removed by adjusting the rotational speed of the working rolls of the roll stand to be removed, and wherein the control device takes the adjustment of the rotational speed of the working rolls of the roll stand to be removed into consideration in at least one roll stand, which is positioned downstream of the roll stand to be removed and is likewise rolling the rolling stock, of the continuous rolling train.

7. The operating method according to claim 5, wherein during the relief of load of the roll stand to be removed, the control device regulates a tension prevailing in a section of the rolling stock running into the roll stand to be removed by adjusting the rotational speed of working rolls of a roll stand, which is positioned directly upstream of the roll stand to be removed and is likewise rolling the rolling stock, of the continuous rolling train, and wherein the control device takes the adjustment of the rotational speed of the working rolls of the roll stand, which is positioned directly upstream of the roll stand to be removed and is likewise rolling the rolling stock, into consideration in at least one roll stand, which is positioned indirectly upstream of the roll stand to be removed and is likewise rolling the rolling stock, of the continuous rolling train.

8. An operating method for a continuous rolling train which has a number of roll stands, with a rolling stock passing through the continuous rolling train being rolled in a plurality of the roll stands in succession, such that the rolling stock has predetermined final properties when it leaves the rolling train wherein to integrate a roll stand which is not rolling the rolling stock into the continuous rolling train during the rolling of the rolling stock, the method comprises:

controlling by a control device of the continuous rolling train the roll stand to be integrated such that a rotational speed of working rolls of the roll stand to be integrated corresponds to a setpoint exit speed of the rolling stock at the location of the roll stand to be integrated, and then controls the roll stand to be integrated such that the working rolls are screwed down on the rolling stock but the rolling stock is not yet rolled in the roll stand to be integrated, after the screw-down of the working rolls of the roll stand to be integrated on the rolling stock, controlling by the control device the roll stand to be integrated such that the roll stand to be integrated has load applied to it according to a defined temporal load application profile, such that the roll stand to be integrated rolls a certain section of the rolling stock during the load application profile, controlling by the control device at least one other of the roll stands of the continuous rolling train such that the at least one other roll stand is relieved of load according to a defined temporal load relief profile, wherein the load application profile of the roll stand to be integrated and the load relief profile of the at least one other roll stand are coordinated with one another such that, during the load relief profile, the at least one other roll stand rolls one and the same section of the rolling stock as the roll stand to be integrated during the load application profile, and such that the final properties of the rolling stock are maintained, after the application of load, controlling by the control device the rotational speed of the working rolls of the roll stand to be integrated such that an exit speed, effected by the rolling of the rolling stock in the roll stand to be integrated, of the rolling stock at the location of the roll stand to be integrated corresponds at all times to the setpoint exit speed.

9. The operating method according to claim 8, wherein, to compensate the application of load to the roll stand to be integrated, the control device relieves a single other roll stand of load.

10. The operating method according to claim 8, wherein, to compensate the application of load to the roll stand to be integrated, the control device removes the at least one other roll stand from the continuous rolling train.

11. The operating method according to claim 8, wherein, to apply load to the roll stand to be integrated, the control device controls a rolling gap of the roll stand to be integrated by correspondingly predefining a speed relationship relative to a roll stand, which is positioned upstream of the roll stand to be integrated and is rolling the rolling stock, of the continuous rolling train in conjunction with tension regulation, which acts on the screw-down of the roll stand to be integrated, for a section of the rolling stock running into the roll stand to be integrated.

12. The operating method according to claim 8, wherein, to apply load to the roll stand to be integrated, the control device controls a rolling gap of the roll stand to be integrated by position regulation or force regulation.

13. The operating method according to claim 12, wherein during the application of load to the roll stand to be integrated, the control device regulates a tension prevailing in a section of the rolling stock running into the roll stand to be integrated by adjusting the rotational speed of the working rolls of the roll stand to be integrated, and wherein the control device takes the adjustment of the rotational speed of the working rolls of the roll stand to be integrated into consideration in at least one roll stand, which is positioned downstream of the roll stand to be integrated and is rolling the rolling stock, of the continuous rolling train.

14. The operating method according to claim 12, wherein during the application of load to the roll stand to be integrated, the control device regulates a tension prevailing in a section of the rolling stock running into the roll stand to be integrated by adjusting a rotational speed of working rolls of a roll stand, which is positioned directly upstream of the roll stand to be integrated and is rolling the rolling stock, of the continuous rolling train, and wherein the control device takes the adjustment of the rotational speed of the working rolls of the roll stand, which is positioned directly upstream of the roll stand to be integrated and is rolling the rolling stock, into consideration in at least one roll stand, which is positioned indirectly upstream of the roll stand to be integrated and is likewise rolling the rolling stock, of the continuous rolling train.

15. A computer program product comprising a computer readable medium which has machine code stored which can be executed directly by a control device of a continuous rolling train and the execution of which by the control device has the effect that the control device operates the continuous rolling train according to an operating method as claimed in claim 1.

16. A computer program product comprising a computer readable medium which has machine code stored which can be executed directly by a control device of a continuous rolling train and the execution of which by the control device has the effect that the control device operates the continuous rolling train according to an operating method as claimed in claim 8.

17. A control device of a continuous rolling train comprising a plurality of roll stands, which control device is operable:

to control a roll stand to be removed such that the roll stand to be removed is completely relieved of load according to a defined temporal load relief profile, and such that the roll stand to be removed rolls a certain section of a rolling stock during the load relief profile, to control at least one other of the roll stands of the continuous rolling train such that the at least one other roll stand has load applied to it according to a defined temporal load application profile, wherein the load relief profile of the roll stand to be removed and the load application profile of the at least one other roll stand are coordinated with one another such that, during the load application profile, the at least one other roll stand rolls one and the same section of the rolling stock as the roll stand to be removed during the load relief profile, and such that the final properties of the rolling stock are maintained, to control a rotational speed of working rolls of the roll stand to be removed until the roll stand to be removed is completely relieved of load, in such a way that an exit speed of the rolling stock effected by the rolling of the rolling stock in the roll stand to be removed corresponds at all times to a predetermined setpoint exit speed, and to control the roll stand to be removed, after the roll stand to be removed has been completely relieved of load, and so as to maintain a correspondence of the rotational speed of the working rolls with the setpoint exit speed, such that the working rolls of the roll stand to be removed are lifted off the rolling stock, and said control device then brings the roll stand to be removed to a stop.

18. A continuous rolling train having a number of roll stands and having a control device according to claim 17, with the roll stands being controlled by the control device.

19. A control device of a continuous rolling train comprising a plurality of roll stands, which control device is operable:

to control a roll stand to be integrated such that a rotational speed of working rolls of the roll stand to be integrated corresponds to a setpoint exit speed of the rolling stock at the location of the roll stand to be integrated, and then controls the roll stand to be integrated such that the working rolls are screwed down on the rolling stock but the rolling stock is not yet rolled in the roll stand to be integrated, after the screw-down of the working rolls of the roll stand to be integrated on the rolling stock, to control the roll stand to be integrated such that the roll stand to be integrated has load applied to it according to a defined temporal load application profile, such that the roll stand to be integrated rolls a certain section of the rolling stock during the load application profile, to control at least one other of the roll stands of the continuous rolling train such that the at least one other roll stand is relieved of load according to a defined temporal load relief profile, wherein the load application profile of the roll stand to be integrated and the load relief profile of the at least one other roll stand are coordinated with one another such that, during the load relief profile, the at least one other roll stand rolls one and the same section of the rolling stock as the roll stand to be integrated during the load application profile, and such that the final properties of the rolling stock are maintained, after the application of load, to control the rotational speed of the working rolls of the roll stand to be integrated such that an exit speed, effected by the rolling of the rolling stock in the roll stand to be integrated, of the rolling stock at the location of the roll stand to be integrated corresponds at all times to the setpoint exit speed.

20. A continuous rolling train having a number of roll stands and having a control device according to claim 19, with the roll stands being controlled by the control device.

* * * * *